US006051764A

United States Patent [19]

Sakurai

[11] Patent Number: 6,051,764

[45] Date of Patent: Apr. 18, 2000

[54] STRINGED MUSICAL INSTRUMENT FORMED FROM BAMBOO PLATES

[75] Inventor: Hiroshi Sakurai, Shizuoka, Japan

[73] Assignee: Yamaha Corporation, Japan

[21] Appl. No.: 09/261,110

[22] Filed: Mar. 3, 1999

[30] Foreign Application Priority Data

Mar. 6, 1998 [JP] Japan ..... 10-055113
Jan. 13, 1999 [JP] Japan ..... 11-007025

[51] Int. Cl.[7] ..... G10D 3/00

[52] U.S. Cl. ..... 84/291; 84/290; 84/293

[58] Field of Search ..... 446/408; 84/267, 84/268, 269, 274, 290, 291, 293

[56] References Cited

U.S. PATENT DOCUMENTS

| | | | |
|---|---|---|---|
| 510,335 | 12/1893 | Fairbanks | 84/268 |
| 573,357 | 12/1896 | Rethey | 84/268 |
| 663,440 | 12/1900 | Isbell | 84/268 |
| 1,960,380 | 5/1934 | Jordan | 273/107.5 |
| 3,440,919 | 4/1969 | Baker | 84/291 |
| 3,805,663 | 4/1974 | Okugawa | 84/293 |
| 4,184,404 | 1/1980 | Tomioka | 84/293 |
| 4,810,551 | 3/1989 | Chu | 428/106 |
| 5,171,616 | 12/1992 | Dejima | 428/22 |
| 5,247,132 | 9/1993 | Henderson | 84/735 |
| 5,682,003 | 10/1997 | Jarowsky | 84/267 |

OTHER PUBLICATIONS

Marcuse, S. (editor): A Survey of Musical Instruments, Harper & Row Publishers, Inc., New York, pp. 177 and 189–194., 1975.

Popular Science, vol. 176, No. 3, p. 147, Mar. 1960.

Dearling, R. (editor): The Illustrated Encyclopedia of Musical Instruments, Carlton Books, Ltd., New York, p. 197, 1996.

The Encyclopedia Britannica, (15th edition), p. 670, 1994.

*Primary Examiner*—Brian Sircus
*Assistant Examiner*—Kim Lockett
*Attorney, Agent, or Firm*—Ostrolenk, Faber, Gerb & Soffen, LLP

[57] ABSTRACT

Bamboo fibers uniformly extend in the longitudinal direction of a bamboo stem so as to impart good acoustic properties to bamboo plates formed from bamboo strips, and the bamboo plates are available for a component parts of a body and a neck both forming part of an acoustic guitar, because the bamboo is easily economically obtainable.

22 Claims, 8 Drawing Sheets

STRINGED MUSICAL INSTRUMENT FORMED FROM BAMBOO PLATES

FIELD OF THE INVENTION

This invention relates to a stringed musical instrument and, more particularly, to a stringed musical instrument such as, for example, a guitar, an electric acoustic guitar and a Japanese modern two-stringed plucked musical instrument called as "Taishogoto" in Japanese.

DESCRIPTION OF THE RELATED ART

An acoustic guitar is broken down into a body, a neck, turning keys, a tailpiece, bridges and strings. The body and the neck are usually formed of wood, and wooden boards define a hollow space or a resonator in the body. The large resonator makes the acoustic sound loud, and reverberates low-pitched tones. If the resonator is small, a player appreciates it for high-pitched tones. Thus, the body affects the acoustic sound.

A front board, a rear board and side boards form in combination the body, and the front board has the strongest acoustic influence on the sound like the sound board of an acoustic piano. For this reason, the front board is usually formed of a kind of wood superior in acoustic properties.

The thinner the front board is, the more it vibrates. The wide vibrations result in loud sound, and it is desirable to use a thin wooden plate for the front board. Even so, the tailpiece is attached to the front board. The strings are stretched between the turning keys and the tailpiece, and each string exerts the tensile force of the order of 6–7 kilograms on the tailpiece. Therefore, the manufacturer is to give appropriate mechanical strength to the front board. Plural wooden sound bars are bonded to the front board in order to propagate the vibrations from the bridge to the entire surface of the front board, and wooden reinforce members increases the mechanical strength. The rear board and the side boards are expected to offer large mechanical strength rather than good acoustic properties. The manufacturer forms the rear board and the side boards from wooden plates harder than the front board.

A fingerboard is bonded to a reinforcing bar, and the fingerboard and the reinforcing bar form in combination the neck. The reinforcing bar is stiff enough to withstand the bending moment due to the tensile force of the strings. Frets are embedded in the fingerboard at intervals, and the player presses the strings against the fingerboard during the performance. Not only the strings but also the fingers are pressed against the fingerboard, and the fingerboard is liable to be soiled. For this reason, the fingerboard is formed of another kind of wood making the stains inconspicuous and less worn away.

Thus, the components of the guitar have different duties, and, accordingly, different kinds of wood are used for the components. Typical examples are listed in the following table.

TABLE

| Components | Wood | | |
|---|---|---|---|
| Front board | Spruce | Silver fir | Cedar |
| Rear board & Side boards | Indian rose | Maple | Mahogany Jacaranda |
| Reinforcing bar | Mahogany | Maple | |

TABLE-continued

| Components | Wood | |
|---|---|---|
| Fingerboard & Tail piece | Ebony | Indian rose |
| Sound bar & Reinforce member | Spruce | Mahogany |

The other components, i.e., the strings, the turning keys, the bridges and the frets are formed of metal or synthetic resin, and the metal and the synthetic resin are easily obtainable. However, the wood such as the spruce, the silver fir and ebony are getting a little, and the manufacturer feels the stable supply difficult in future. For this reason, the manufacturer changes those kinds of wood to the south-sea wood such as lauan and china wood. However, a large amount of south-sea wood is consumed as the building material. For this reason, stable supply is doubtful.

SUMMARY OF THE INVENTION

It is therefore an important object of the present invention to provide a stringed musical instrument, a part of which is formed of woody material easily economically obtainable and having good acoustic properties.

To accomplish the object, the present invention proposes to use bamboo.

In accordance with one aspect of the present invention, there is provided a stringed musical instrument comprising a body structure including at least one component part formed of bamboo, an anchor means attached to the body structure and at least one strings anchored at the anchor means so as to be stretched over the body structure and vibrating for generating sounds.

BRIEF DESCRIPTION OF THE DRAWINGS

The features and advantages of a stringed musical instrument will be more clearly understood from the following description taken in conjunction with the accompanying drawings in which.

DESCRIPTION OF THE PREFERRED EMBODIMENTS

Acoustic Properties of Bamboo

Bamboo is defined in Webster's Third New International Dictionary as "woody or arborescent grass of Bambura, Arundinaria, Dendrocalamus, and related genera (tribe Bambuseae) widely distributed chiefly in the tropics and subtropics of both hemispheres". Although bamboo is much lower in price than wood such as spruce, it is not popular in the building industry. Bamboo grows faster than trees. For this reason, bamboo is easily and economically obtainable.

A bamboo is formed from thin long fibers gathered at high density. The thin long fibers uniformly extend along the longitudinal direction of the bamboo, and are strong and flexible. However, the cohesion between the bamboo fibers is small. When small compressive force is exerted on a bamboo in the longitudinal direction, the bamboo is easily separated into the bamboo fibers. Those properties are appropriate for a kind of plywood.

The bamboo is cut into bamboo sheets. The reverse surface of one bamboo sheet is, by way of example, bonded to the front sheet of another bamboo sheet so as to form a lamination. The lamination is less warped under a temperature difference. Thus, the bamboo is available for various structures of plywood. Some kinds of plywood have large mechanical strength and/or good acoustic properties, and are appropriate for the board or boards of the stringed musical instrument.

In detail, the bamboo offers good propagation characteristics to acoustic waves in the direction of the bamboo fibers. However, the acoustic waves are less propagated across the bamboo fibers. In fact, the acoustic wave velocity in the direction of the bamboo fibers is larger than that of wood, but the acoustic wave velocity in the direction across the bamboo fibers is smaller than that of wood. When the body of a stringed musical instrument is made of bamboo, the bamboo fibers rapidly propagate the acoustic waves over the body, and make the phase difference small. The body rapidly decays the higher harmonics of the acoustic sound, and restricts the spirit vibrations. As a result, the body generates clear acoustic sound. This feature is desirable for an electric acoustic stringed musical instrument. The electric acoustic stringed instrument will be hereinbelow described as an embodiment of the present invention. A pickup is incorporated in the electric acoustic stringed instrument, and converts the acoustic sound to an electric signal. The acoustic sound generated in the bamboo body is clear, and a preamplifier easily imparts a selected timbre to the electric sound on the basis of the clear acoustic sound. Thus, bamboo is appropriate for a body of a stringed musical instrument.

First Embodiment

Figure 1:
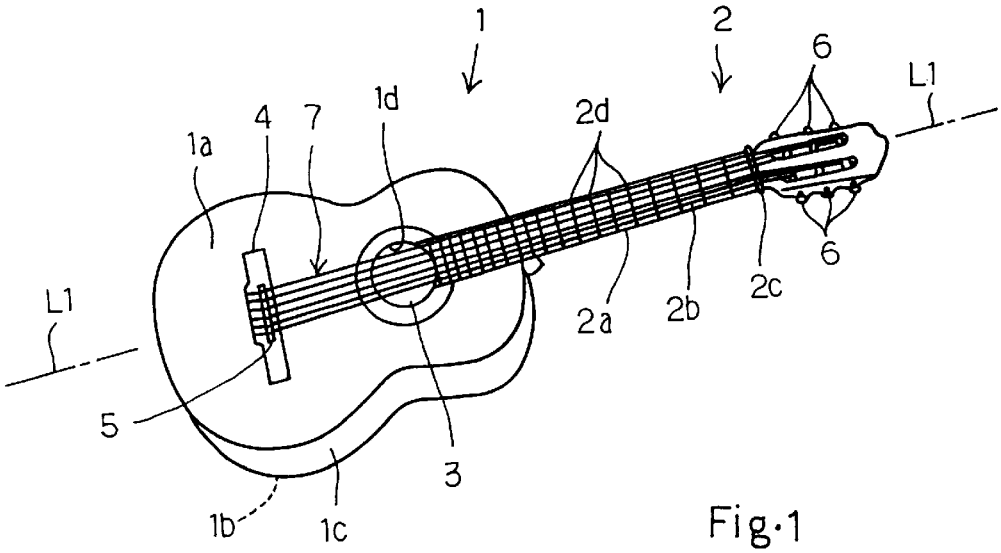
FIG. 1 is a perspective view showing an acoustic guitar according to the present invention.

Referring to FIG. 1 of the drawings, an acoustic guitar embodying the present invention comprises a body 1, a neck 2 projecting from the body 1. The body 1 is constricted, and includes a front board 1*a*, a rear board 1*b* and a side board 1*c* or boards 1*c*. The front board 1*a* and the rear board 1*b* have contours identical with each other, and are symmetrical with respect to a line L1. The front board 1*a* is spaced from the rear board 1*b*, and the side boards 1*c* are connected along the outer peripheries of the front/rear boards 1*a*/1*b*. The front board 1*a*, the rear board 1*b* and the side boards 1*c* thus assembled form hollow space serving as a resonator 3. A circular aperture is formed in the front board 1*a*, and serves as a sound hole 1*d*. The resonator 3 is open to the air through the sound hole 1*d*.

The neck 2 is connected to the body 1, and is elongated along the line L1. The neck 2 includes a neck body 2*a* bonded to the body 1, a finger board 2*b* attached to the front surface of the neck body 2*a*, an upper bridge saddle 2*c* embedded into the leading end portion of the finger board 2*b* and plural frets 2*d* attached to the finger board at intervals. The leading end portion of the neck body 2*a* is widened, and slots are formed. As will be described hereinbelow, the leading end portion serves as a kind of peg box.

The acoustic guitar further comprises a bridge 4 attached to the front board 1*a*, a lower bridge saddle 5 embedded in the bridge 4, turning keys 6 screwed into the leading end portion of the neck body 2*a* and strings 7 stretched between the bridge 4 and the turning keys 6. The strings 7 are terminated at the turning keys 6, and a player gives appropriate tensions to the strings 7 through rotation of the turning keys 6. The acoustic guitar has the contour similar to that of the prior art acoustic guitar. When the player plucks the strings 7, the strings 7 vibrate, and the vibrations are propagated through the bridge 4 to the body 1. The body 1 generates the acoustic sound from the vibrations, and the resonator 3 makes the acoustic sound loud. The acoustic sound is radiated through the sound hole 1*d*. When the player selectively presses the strings 7 against the finger board 2*b*, the strings 7 are brought into contact with the frets 2*d*, and the vibrating strings 7 change the pitches of the acoustic sound.

Figure 2:
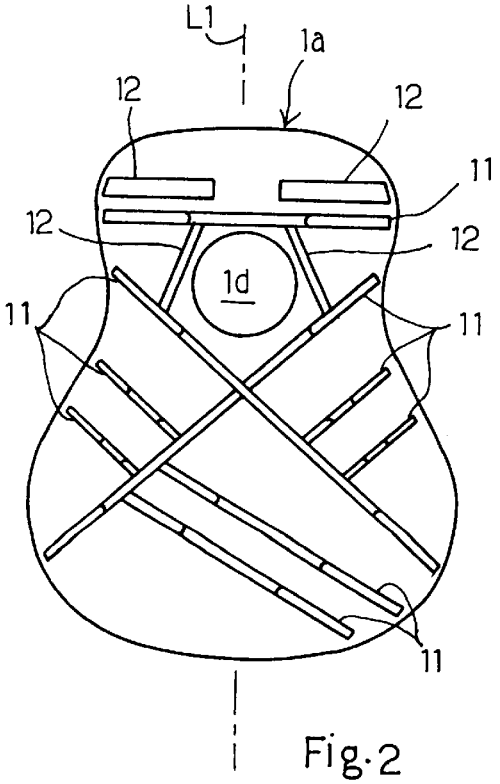
FIG. 2 is a plane view showing a reverse surface of a front board forming a part of the body of the acoustic guitar.
Figure 3:
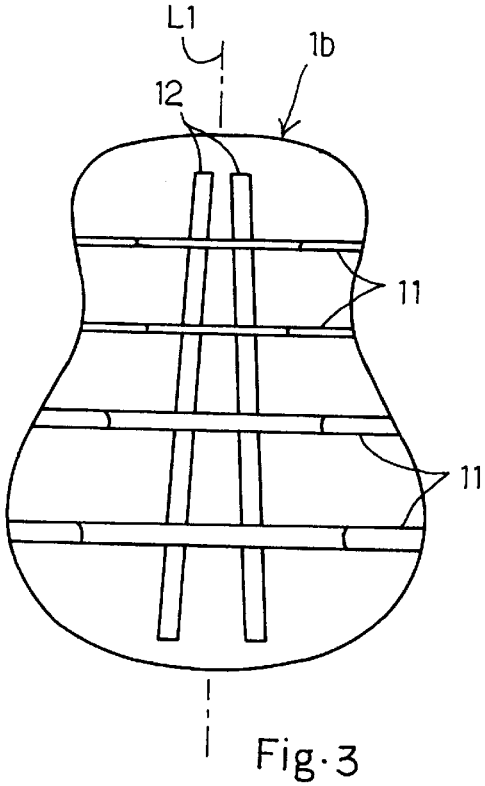
FIG. 3 is a plane view showing a reverse surface of a rear board forming a part of the body of the acoustic guitar.

FIG. 2 shows the reverse surface of the front board 1*a*, and FIG. 3 shows the reverse surface of the rear board 1*b*. Sound bars 11 and reinforce members 12 are bonded to the reverse surfaces. The reinforce members 12 enhance the mechanical strength of the boards 1*a*/1*b*, and the sound bars 11 propagate the vibrations of the bridge 4 over the front/rear boards 1*a*/1*b*.

Thus, various parts are assembled into the acoustic guitar, and are formed of woody material except the strings 7, the bridge saddles 2*c*/5, the turning keys 6 and the frets 2*d*. In this instance, the front board 1*a*, the rear board 1*b*, the side boards 1*c*, the sound bars 11, the reinforce members 12, the neck body 2*a*, the finger board 2*b* and the bridge 4 are formed of bamboo. The other parts, i.e., the front board 1*a*, the rear board 1*b*, the side boards 1*c*, the sound bars 11, the reinforce members 12, the neck body 2*a*, the finger board 2*b* and the bridge 4 are similar in configuration to those of the prior art acoustic guitar.

Figure 4:
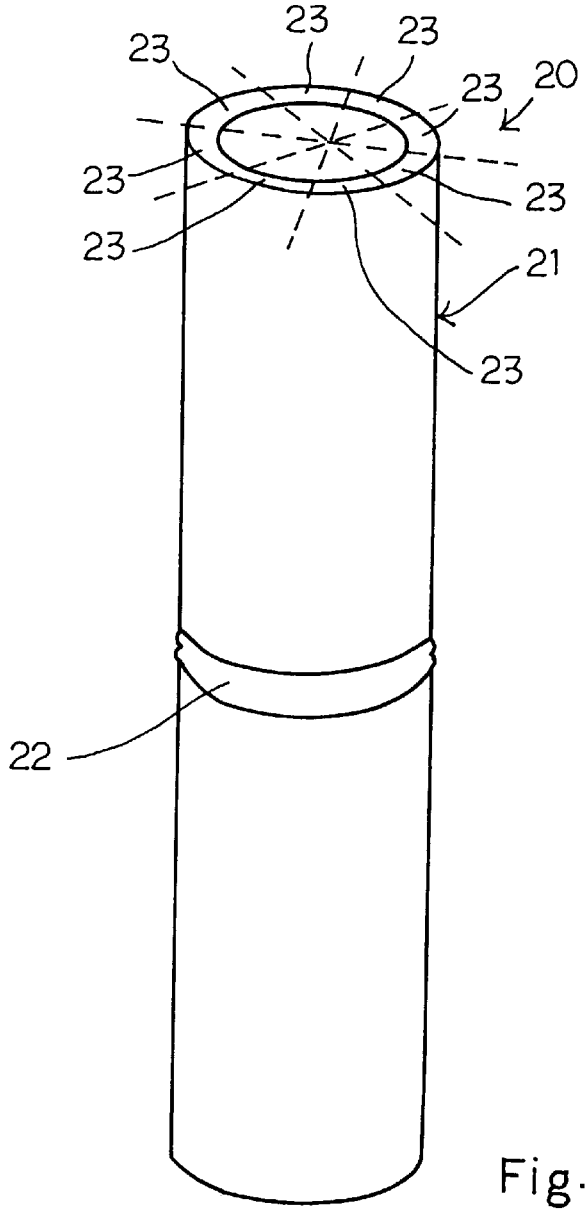
FIG. 4 is a perspective view showing a bamboo stem available for bamboo plates.
Figure 5:
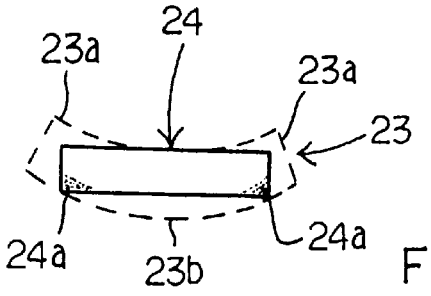
FIG. 5 is a plane view showing an edge of a bamboo strip cut from an arc piece of the bamboo stem.

The bamboo is formed into bamboo plates available for the other parts as follows. FIG. 4 illustrates a bamboo stem 20. The bamboo stem 20 belongs to a species of thick-stemmed bamboo. Of course, other species such as grown in Asian countries, African countries and North/South American countries is available for the other parts. The bamboo has a subterranean stem and a terrestrial stem. The terrestrial stem is appropriate for the bamboo plates.

The manufacturer firstly selects bamboo stems that are close in age and color to one another. The manufacturer checks the bamboo stems to see whether stains and scratches are serious or not. When the bamboo stems are acceptable, the manufacturer cuts the bamboo stem 20 into cylindrical parts 21. If there is a node 22, the manufacturer grinds the node 21, and makes the outer surface smooth.

Subsequently, the manufacturer cuts the cylindrical part 21 into arc pieces 23. In this instance, the cylindrical part 21 is cut into eight arc pieces along broken lines. Of course, the cylindrical part 21 may be cut into more than eight arc pieces depending upon the diameter of the bamboo stem 20. The corners 23*a* and a curved outer surface portion 23*b* are removed from the arc piece 23, and a bamboo strip 24 is formed from the arc piece 23. Although most of the epidermis is removed from the bamboo strip 24, residual epidermis 24*a* is seen as indicated by dots.

Figure 6:
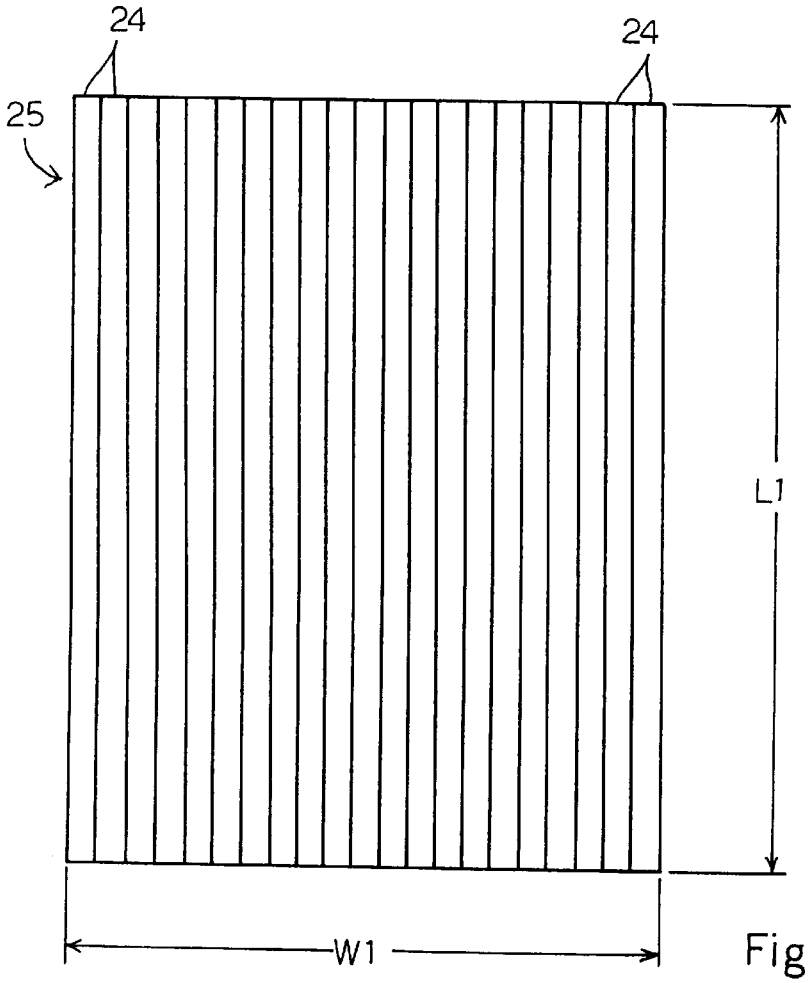
FIG. 6 is a plane view showing a bamboo plate formed from the bamboo strips for a front board and a rear board.
Figure 7:
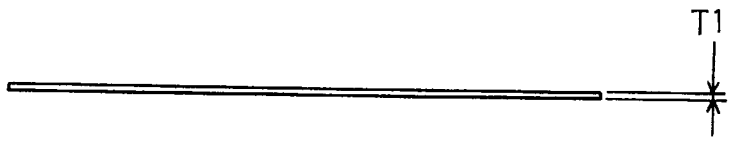
FIG. 7 is a side view showing the bamboo plate of FIG. 6.
Figure 8:
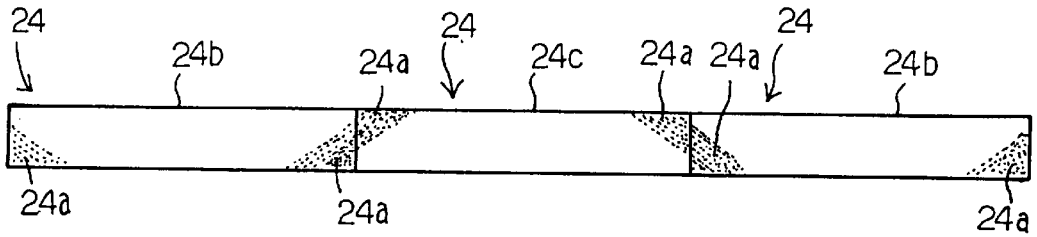
FIG. 8 is a side view showing the side surfaces of the bamboo strips assembled together.

The bamboo strips 24 are arranged as shown in FIG. 6. Only four bamboo strips are labeled with reference 24 for the sake of simplicity. The bamboo strips 24 form a bamboo plate 25, and the bamboo plate 25 has length L1 of 550 millimeters, width W1 of 420 millimeters and thickness T1 of 3 millimeters. When the manufacturer intends to use the bamboo plate 25 for a wide part, the bamboo plate 25 may have different dimensions. Every other bamboo strip 24 is turned the inside 24*b* out, and the remaining bamboo strips keep the outside 24*c* out as shown in FIG. 8, so that the insides 24*b* (i.e., inner surfaces) of one bamboo strip 24 form a major surface of the bamboo plate 25 together with the outsides 24*c* (i.e., outer surfaces) of adjacent bamboo strips 24. The bamboo strips 24 are bonded to one another without gap therebetween. This feature is desirable, because the bamboo plate 25 is less warped under temperature difference. The residual epidermis 24*a* is periodically seen on the outer surface of the bamboo plate 25 like the grain of wood. The manufacturer shapes the bamboo plates 25 into the front board 1*a* and the rear board 1*b*.

Figure 11:
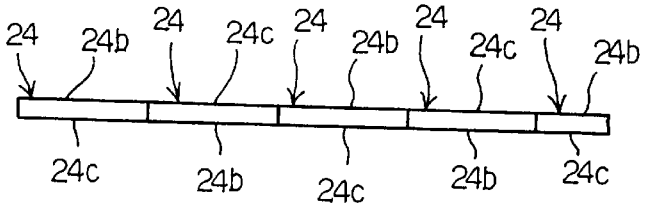
FIG. 11 is a side view showing the side surfaces of the bamboo strips assembled together.
Figure 9:
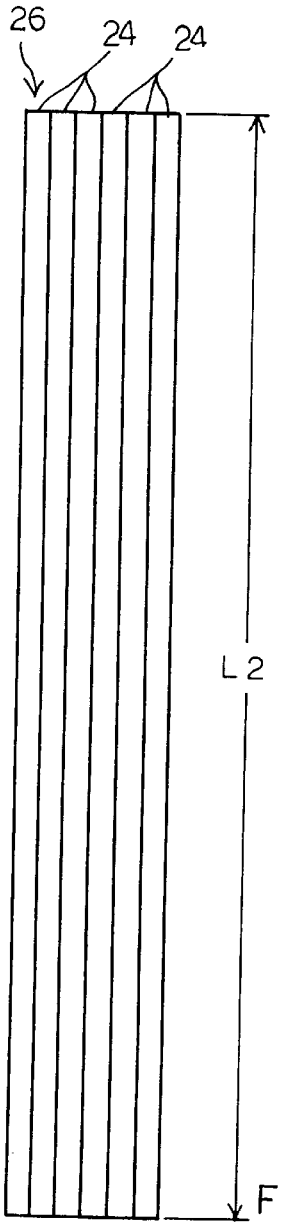
FIG. 9 is a plane view showing another bamboo plate available for a side board.
Figure 10:
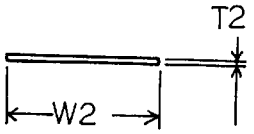
FIG. 10 is a side view showing the bamboo plate of FIG. 7.

FIGS. 9 and 10 illustrate another bamboo plate 26 for the side board 1*c*. The bamboo plate 26 has length L2 of 850 millimeters, width W2 of 120 millimeters and thickness T2 of 2.5 millimeters. The bamboo strips 24 are prepared as similar to those for the bamboo plate 25. The manufacturer puts the bamboo strips 24 side by side, and the inner surface 24*b* is alternated with the outer surface 24*c* as shown in FIG. 11. The bamboo strips 24 are bonded to the adjacent bamboo strips 24 without gap, and are formed into the bamboo plate 26. The bamboo plate 26 is shaped into the side board 1*c*.

Figure 12:
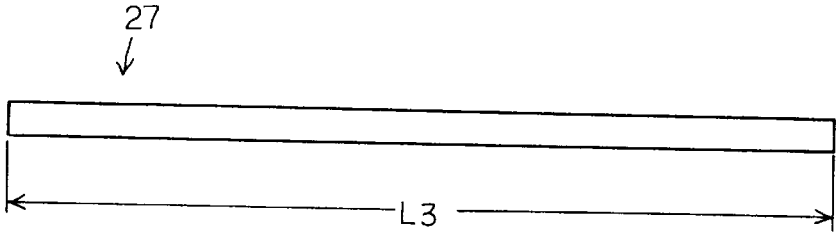
FIG. 12 is a plane view showing yet another bamboo plate available for a sound bar and a reinforce member.
Figure 13:
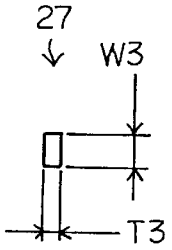
FIG. 13 is a side view showing the bamboo plate of FIG. 12.
Figure 14:
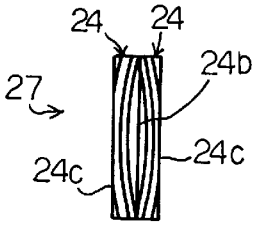
FIG. 14 is a cross sectional view showing the bamboo plate of FIG. 12.

FIGS. 12 and 13 illustrate a bamboo plate 27 available for the sound bars 11 and the reinforce members 12. The bamboo plate 27 has length L3 of 500 millimeters, width W3 of 20 millimeters and thickness T3 of the order of 10 millimeters. The manufacturer prepares the bamboo strips 24 as similar to those of the bamboo plate 25. A pair of bamboo strips 24 is used for the bamboo plate 27, and the inner surface 24*b* of one bamboo strip 24 is bonded to the inner surface 24*b* of the other bamboo strip 24 without gap. For this reason, the outer surfaces 24*c* serve as both surfaces of the bamboo plate 27 as shown in FIG. 14. The bamboo plate 27 is less warped under temperature difference.

Figure 15:
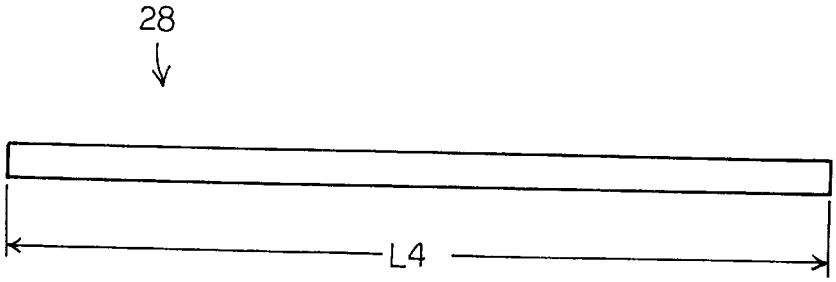
FIG. 15 is a plane view showing still another bamboo plate available for a sound bar and a reinforce member.
Figure 16:
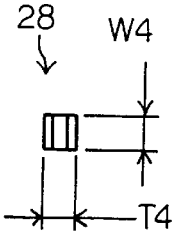
FIG. 16 is a side view showing the bamboo plate of FIG. 15.

FIGS. 15 and 16 illustrate another bamboo plate 28 also available for the sound bars 11 and the reinforce members 12. The bamboo plate 28 has length L4 of 500 millimeters, width W4 of 20 millimeters and thickness T4 of the order of 20 millimeters. Thus, the bamboo plate 28 is twice thicker than the bamboo plate 27.

Figure 17:
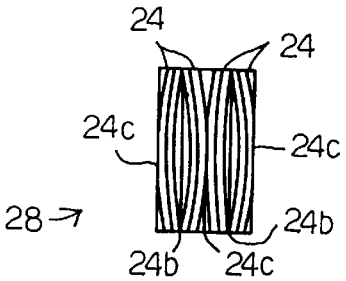
FIG. 17 is a cross sectional view showing the bamboo plate of FIG. 15.

The manufacturer firstly forms the bamboo strips 24 as similar to those for the bamboo plate 25. Two pairs of bamboo strips 24 are used for the bamboo plate 27. The bamboo strips 24 are alternately laminated in such a manner that inner surface 24*b* and the outer surface 24*c* of one bamboo strip 24 are respectively laminated on the inner surface of an adjacent bamboo strip 24 and the outer surface of another adjacent bamboo strip 24 as shown in FIG. 17. The outer surfaces 24*c* serve as both surfaces of the bamboo plate 28. Two bamboo plates 27 may be bonded to one another without gap. The bamboo plate 28 is less warped under temperature difference.

Figure 18:
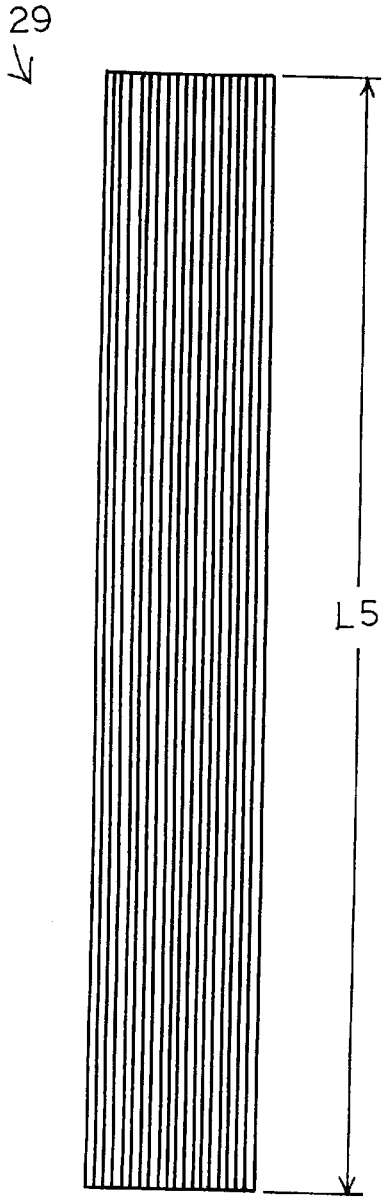
FIG. 18 is a plane view showing a bamboo plate available for a neck body.
Figure 19:
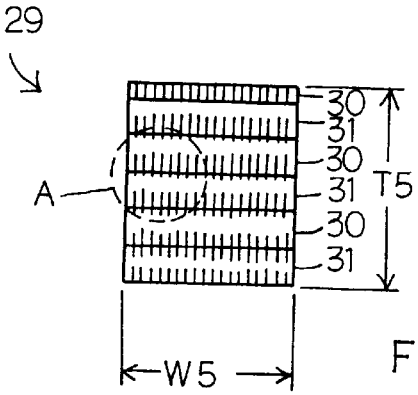
FIG. 19 is a side view showing the bamboo plate of FIG. 18.
Figure 20:
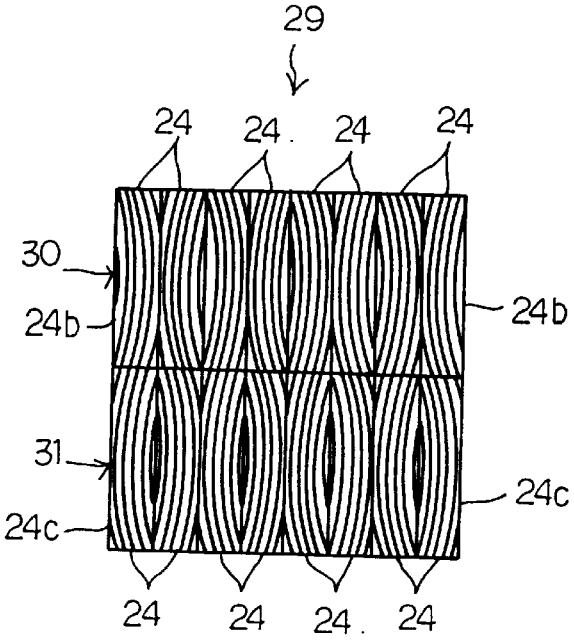
FIG. 20 is a side view showing a part of the bamboo plate encircled in dots-and-dash line A of FIG. 19.

FIGS. 18, 19 and 20 illustrate yet another bamboo plate 29 available for the neck body 2*a*. The bamboo plate 29 has length L5 of 630 millimeters, width W5 of 95 millimeters and thickness T5 of 110 millimeters.

The manufacturer firstly forms the bamboo strips 24 as similar to those for the bamboo plate 25. The manufacturer laminates the bamboo strips 24, and bonds the bamboo strips 24 without gap so as to obtain two kinds of bamboo sub-plates 30/31. The bamboo strips 24 are laminated in such a manner that the inner surface 24*b* and the outer surface 24*c* are held in contact with the inner surface 24*b* of one adjacent bamboo strip 24 and the outer surface 24*c* of the other adjacent bamboo strip 24, and are bonded without gap. The bamboo sub-plate 30 exposes the inner surfaces to both sides thereof, and the bamboo sub-plate 31 exposes the outer surfaces to both sides thereof as shown. The bamboo sub-plates 30 are alternated with the bamboo sub-plates 31, and are bonded without gap. The inner surfaces 24*b* and the outer surfaces 24*c* are alternately exposed to each of the side surfaces of the bamboo plate 29, and the bamboo plate 29 is less warped under temperature difference.

Figure 21:
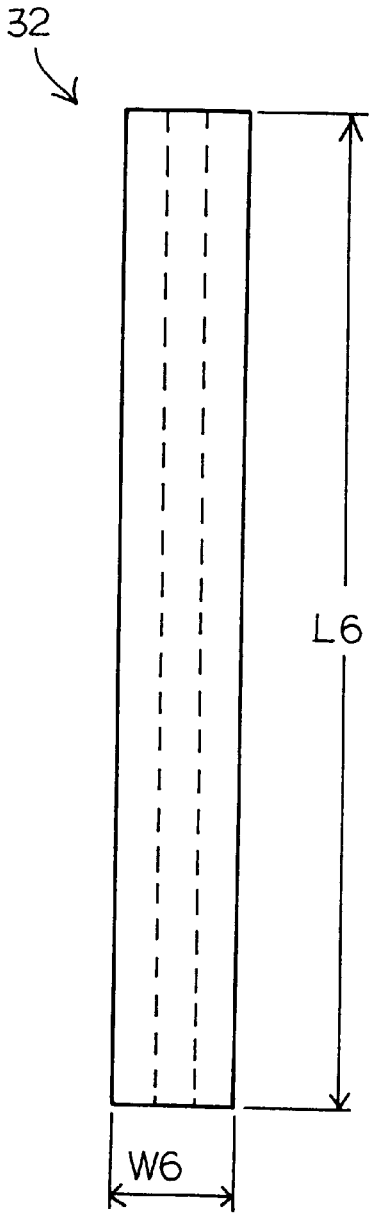
FIG. 21 is a plane view showing another bamboo plate available for a finger board.
Figure 22:
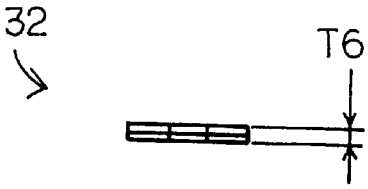
FIG. 22 is a side view showing the bamboo plate of FIG. 21.
Figure 23:
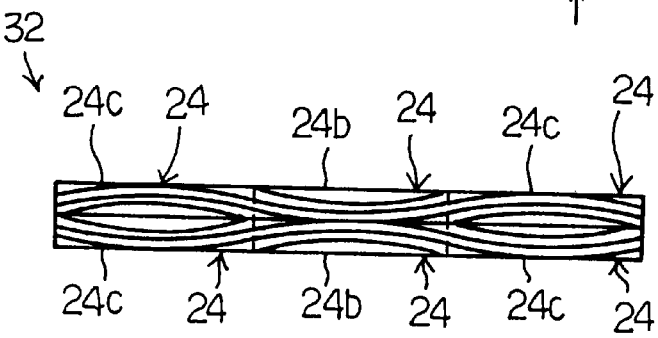
FIG. 23 is a side view showing the bamboo plate of FIG. 21 at large magnification ratio.

FIGS. 21, 22 and 23 illustrate a bamboo plate 32 available for the finger board 2*b*. The bamboo plate 32 has length L6 of 500 millimeters, width W6 of 60 millimeters and thickness T6 of 6 millimeters. The manufacturer forms the bamboo strips 24 as similar to those for the bamboo plate 25. In this instance, three pairs of bamboo strips 24 are used for the bamboo plate 32. The first pair has the bamboo strips 24, the outer surfaces of which are bonded to one another. As a result, the inner surfaces 24*c* are exposed to both surfaces of the first pair. On the other hand, the bamboo strips 24 of the other pairs have inner surfaces 24*b* bonded to one another, and, accordingly, the outer surfaces 24*c* are exposed to both sides of the second/third pair. The second pair and the third pair are placed on both sides of the first pair, and are bonded to the first pair without gap. The bridge 4 is also formed from the bamboo strips 24.

As will be understood from the foregoing description, the body 1, the neck 2 and the bridge 4 are formed from the bamboo strips 24. Any scarce wood such as spruce, cedar and Indian rose is never required for the acoustic guitar according to the present invention. The bamboo is economical. The bamboo is rapidly grown, and is constantly supplied to the manufacturer. The manufacturer does not need a large amount of stock. Moreover, the bamboo strips 24 are easily assembled into the plates 25/26/27/28/29/32, and the manufacture does not need special machines. For this reason, the manufacturer reduces the production cost of the stringed musical instrument.

The bamboo has constant cellular texture, and the cellular texture is straightly continued. Moreover, the bamboo plates 25/26/27/28/29/32 are less warped under temperature difference. For this reason, the stringed musical instrument according to the present invention is stable, and constantly generates the acoustic sound. In fact, the present inventor fabricated the acoustic guitar according to the present invention, and compared the acoustic sound with the acoustic sound of the prior art acoustic guitar. The difference of timbre was ignoreable.

In the first embodiment, the body 1, the neck 2, the bridge 4 and said bridge saddle 5 as a whole constituted a body structure.

Second Embodiment

Figure 24:
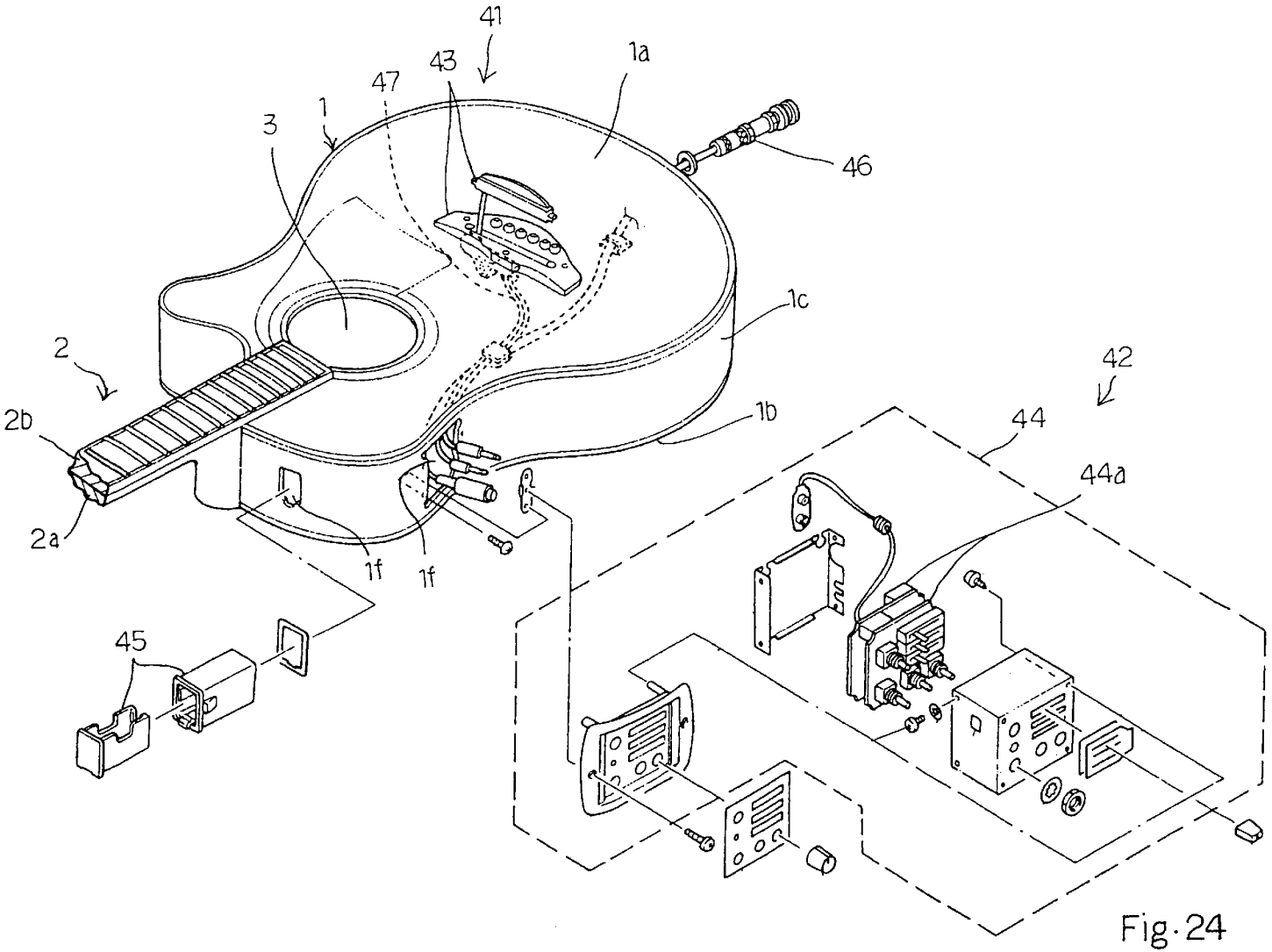
FIG. 24 is a fragmentary perspective view showing an electric acoustic guitar according to the present invention.

Turning to FIG. 24 of the drawings, an electric acoustic guitar embodying the present invention largely comprises an acoustic guitar 41 and an electric sound generating system 42. The acoustic guitar 41 is similar to the acoustic guitar implementing the first embodiment, and component parts are labeled with the same references designating corresponding component parts of the first embodiment without detailed description. At least three holes 1*f* are formed in the side board 1*c*.

The electric sound generating system 42 includes a pickup assembly 43, a pre-amplifier assembly 44, a battery holder assembly 45 and cord 46/47. The bridge 4 is replaced with the pickup assembly 43. The pickup assembly 43 is attached to the front board 1*a*, and coverts the vibrations to an electric signal. The electric signal is supplied through the cord 47 to the pre-amplifier assembly 44. The pre-amplifier assembly 44 includes a circuit board 44*a*, and the electric signal is processed by an electric circuit of the circuit board 44*a*. The electric circuit processes the electric signal, and controls the timbre of electric sound to be produced. The electric signal is supplied from the pre-amplifier assembly 44 through the cord 46 to a sound system (not shown), and the sound system generates the electric sound.

As described hereinbefore, the bamboo rapidly decays the high-order harmonics of the vibrations, and restricts split vibrations. For this reason, the high-order harmonics and noise components in the electric signal is little, and the pre-amplifier assembly 44 well controls the timbre.

Though not shown in FIG. 24, a battery unit is held by the battery holder assembly 45, and the battery holder assembly 45 is inserted into the resonator 3 through the first hole 1*f*. The battery unit energizes the pickup assembly 43 and the pre-amplifier assembly 44. The second hole 1*f* is assigned to the pre-amplifier assembly 44, and the cords 46/47 are connected through the hole 1*f* to the pre-amplifier assembly 44 attached to the side board 1*c*. The cord 46 passes through the third hole (not shown), and projects from the resonator 3 to the outside of the body 1.

As will be appreciated from the foregoing description, the bamboo plates 25/26/27/28/29/32 have good acoustic properties, and are appropriate for the component parts of the body 1. The bamboo is economical and easy to shape into component parts. For this reason, the manufacturer can reduce the production cost without sacrifice the quality of sound.

Although particular embodiments of the present invention have been shown and described, it will be obvious to those skilled in the art that various changes and modifications may be made without departing from the spirit and scope of the present invention.

For example, the bamboo plates are available for a body of another stringed musical instrument such as, for example, the Taishogoto and other kinds of stringed musical instrument already known.

Only the body or neck may be formed from the bamboo plates. A part of the body 1 such as, for example, the side board may be formed of wood. Similarly, either neck body or finger board may be formed of wood.

What is claimed is:

1. A stringed musical instrument comprising a guitar including:

a body structure including at least one component part formed from a bamboo plate into which plural bamboo strips are assembled, an anchor means attached to said body structure, and at least one string anchored at said anchor means so as to be stretched over said body structure and vibrating for generating sounds.

2. The stringed musical instrument as set forth in claim 1, in which said body structure includes a body and a neck projecting from said body.

3. The stringed musical instrument as set forth in claim 2, in which a resonator is formed in said body.

4. The stringed musical instrument as set forth in claim 3, in which a front board, a rear board and at least one side board form in combination said body, and define said resonator.

5. The stringed musical instrument as set forth in claim 4, in which at least one of said front board, said rear board and said at least one side board is formed from said bamboo plate.

6. The stringed musical instrument as set forth in claim 4, in which all of said front board, said rear board and said at least one side board are formed from said bamboo plate.

7. The stringed musical instrument as set forth in claim 3, in which said neck includes a neck body attached to said body and a finger board attached to an upper surface of said neck body.

8. The stringed musical instrument as set forth in claim 7, in which at least one of said neck body and said finger board is formed from said bamboo plate.

9. The stringed musical instrument as set forth in claim 7, in which both of said neck body and said finger board are formed from said bamboo plate.

10. The string musical instrument as set forth in claim 2, in which said anchor means includes a bridge attached to said body, a first bridge saddle attached to said bridge, at least one turning key connected to a leading end portion of said neck and a second bridge saddle attached to said neck between stretched between said bridge and said at least one turning key.

11. The stringed musical instrument as set forth in claim 10, which said bridge is formed from said bamboo plate.

12. The stringed musical instrument as set forth in claim 1, in which said at least one component part is formed from a mosaic bamboo plate.

13. The stringed musical instrument as set forth in claim 1, in which an outer surface of each of said strips is formed from a part of an outer peripheral surface of a bamboo stem and an inner surface of each of said strips is formed from a part of an inner peripheral surface of said bamboo stem.

14. The stringed musical instrument as semiconductor forth in claim 12, side surfaces of one of said bamboo strips are connected to side surfaces of adjacent bamboo strips so that said one of said bamboo strips forms a major surface of said bamboo plate together with the outer surfaces of said adjacent bamboo strips.

15. The stringed musical instrument as set forth in claim 13, in which said inner surface of one of said bamboo strips is connected to the inner surface of another of said bamboo strips for forming said bamboo plate so as to expose said outer surfaces to both major surfaces of said bamboo plate.

16. The stringed musical instrument as set forth in claim 13, in which two of said bamboo strips have the outer surfaces connected to each other, and others of said bamboo strips have the inner surfaces connected to the inner surfaces of said two of said bamboo strips.

17. The stringed musical instrument as set forth in claim 13, in which said bamboo strips form plural bamboo sub-plates laminated on one another.

18. The stringed musical instrument as set forth in claim 17, in which each of said plural bamboo sub-plates is assembled in such a manner that the inner surfaces of adjacent two bamboo strips and the outer surfaces of next adjacent two bamboo strips alternately form the boundaries between the bamboo strips, wherein the outer surfaces of the outermost bamboo strips are exposed to both side surfaces of one of said plural bamboo sub-plates, and the inner surfaces of the outermost bamboo strips are exposed to both side surfaces of another of said plural bamboo sub-plates laminated on said one of said plural bamboo sub-plates.

19. The stringed musical instrument as set forth in claim 13, in which said bamboo strips form plural pairs of bamboo strips having side surfaces connected to one another, and the outer surfaces of the bamboo strips of one pair form a boundary therebetween, and the inner surfaces of the bamboo strips of other pairs adjacent to said one pair form respective boundaries between said bamboo strips.

20. The stringed musical instrument as set forth in claim 1, further comprising an electric sound generating system for generating electric sounds.

21. The stringed musical instrument as set forth in claim 20, in which said body structure includes a body having said at least one component part formed of said bamboo and a neck projecting from said body, and said electric sound generating system has a pickup attached to said body for converting the vibrations to an electric signal and a pre-amplifier connected to said pickup for controlling a timbre of said electric sound.

22. The stringed musical instrument as set forth in claim 21, in which a resonator is formed in said body.

* * * * *